US008459626B2

(12) United States Patent
Sawdon et al.

(10) Patent No.: US 8,459,626 B2
(45) Date of Patent: Jun. 11, 2013

(54) PIN CLAMP

(75) Inventors: Edwin G. Sawdon, St. Clair, MI (US); Brian D. Petit, Algonac, MI (US); Michael D. Miller, Marysville, MI (US)

(73) Assignee: BTM Corporation, Marysville, MI (US)

( * ) Notice: Subject to any disclaimer, the term of this patent is extended or adjusted under 35 U.S.C. 154(b) by 369 days.

(21) Appl. No.: 12/790,077

(22) Filed: May 28, 2010

(65) Prior Publication Data

US 2011/0291341 A1 Dec. 1, 2011

(51) Int. Cl.
*B25B 5/12* (2006.01)

(52) U.S. Cl.
USPC ..... 269/228; 269/27

(58) Field of Classification Search
USPC ..... 269/32, 24–27, 20, 228, 216
See application file for complete search history.

(56) References Cited

U.S. PATENT DOCUMENTS

| | | | |
|---|---|---|---|
| 1,048,100 | A | 12/1912 | Rorig |
| 1,667,616 | A | 4/1928 | Wright et al. |
| 1,736,171 | A | 11/1929 | Powell |
| 2,381,999 | A | 8/1945 | Bonnafe |
| 2,577,029 | A | 12/1951 | Moorhead |
| 3,058,214 | A | 10/1962 | Mekler |
| 3,273,878 | A | 9/1966 | Blatt |
| 3,341,190 | A | 9/1967 | Adamson |
| 3,362,703 | A | 1/1968 | Blatt |
| 3,371,923 | A | 3/1968 | Blatt |
| 3,381,954 | A | 5/1968 | Blatt |
| 3,545,050 | A | 12/1970 | Blatt et al. |
| 3,618,931 | A | 11/1971 | Blatt |
| 3,702,185 | A | 11/1972 | Blatt |
| 3,948,502 | A | 4/1976 | Waller et al. |
| 4,240,620 | A | 12/1980 | Tunkers |
| 4,396,183 | A | 8/1983 | Lymburner |
| 4,445,676 | A | 5/1984 | Tunkers |
| 4,494,739 | A | 1/1985 | Valentine |
| 4,496,138 | A | 1/1985 | Blatt |
| 4,591,138 | A | 5/1986 | Baills et al. |
| 4,637,597 | A | 1/1987 | McPherson et al. |
| 4,799,657 | A | 1/1989 | Miller |
| 4,905,973 | A | 3/1990 | Blatt |
| 5,118,088 | A | 6/1992 | Sawdon |

(Continued)

FOREIGN PATENT DOCUMENTS

| | | |
|---|---|---|
| DE | 4020981 A1 | 1/1992 |
| DE | 4030730 A1 | 4/1992 |

(Continued)

OTHER PUBLICATIONS

Partial International Search Report, ISA/EP, Rijswijk, NL, mailed Aug. 22, 2011.

(Continued)

*Primary Examiner* — Robert Canfield
*Assistant Examiner* — Brent W Herring
(74) *Attorney, Agent, or Firm* — Harness, Dickey & Pierce, P.L.C.

(57) ABSTRACT

A clamp having a lock is provided. In another aspect, a fail safe lock maintains the position of a clamping member when fluid pressure or other actuating power is undesirably reduced. Another aspect employs teeth on a locking structure which engage matching teeth on a shaft where engagement of the teeth prevent unclamping of a workpiece. In still another aspect, a manual override member disengages a lock in order to unclamp a workpiece.

41 Claims, 11 Drawing Sheets

U.S. PATENT DOCUMENTS

| | | | | |
|---|---|---|---|---|
| 5,165,670 | A | 11/1992 | Sawdon | |
| 5,171,001 | A | 12/1992 | Sawdon | |
| 5,190,334 | A | 3/1993 | Sawdon | |
| 5,516,173 | A | 5/1996 | Sawdon | |
| 5,647,625 | A | 7/1997 | Sawdon | |
| 5,853,211 | A | 12/1998 | Sawdon et al. | |
| 5,871,250 | A | 2/1999 | Sawdon | |
| 5,884,903 | A | 3/1999 | Sawdon | |
| 6,059,277 | A | 5/2000 | Sawdon et al. | |
| 6,102,383 | A | 8/2000 | Tunkers | |
| 6,364,300 | B1 * | 4/2002 | Kita | 269/32 |
| 6,378,855 | B1 | 4/2002 | Sawdon et al. | |
| 6,439,560 | B2 | 8/2002 | Sawada et al. | |
| 6,502,880 | B1 | 1/2003 | Sawdon | |
| 6,557,840 | B2 | 5/2003 | Sawdon | |
| 6,786,478 | B2 | 9/2004 | Pavlik et al. | |
| 6,877,730 | B2 | 4/2005 | Sawdon et al. | |
| 6,902,159 | B2 | 6/2005 | Sawdon et al. | |
| 6,908,077 | B2 | 6/2005 | Sawdon | |
| 6,913,254 | B2 | 7/2005 | Pavlik et al. | |
| 7,017,895 | B2 * | 3/2006 | Sakamoto | 269/32 |
| 7,029,000 | B2 | 4/2006 | Petit et al. | |
| 7,108,255 | B2 * | 9/2006 | Zajac et al. | 269/32 |
| 7,182,326 | B2 | 2/2007 | McIntosh et al. | |
| 7,188,832 | B2 * | 3/2007 | Kita et al. | 269/32 |
| 7,370,856 | B2 | 5/2008 | Sawdon et al. | |
| 7,448,607 | B2 | 11/2008 | Steele et al. | |
| 7,467,788 | B2 | 12/2008 | McIntosh et al. | |
| 7,516,948 | B2 | 4/2009 | McIntosh et al. | |
| 8,132,801 | B2 | 3/2012 | Miyashita et al. | |
| 2001/0003388 | A1 | 6/2001 | Takahashi et al. | |
| 2003/0234478 | A1 | 12/2003 | Steele et al. | |
| 2005/0035516 | A1 | 2/2005 | Sawdon et al. | |
| 2006/0049565 | A1 | 3/2006 | Petit et al. | |
| 2008/0230973 | A1 | 9/2008 | Miyazaki | |

FOREIGN PATENT DOCUMENTS

| | | | |
|---|---|---|---|
| DE | 20105949 | U1 | 8/2001 |
| DE | 10004506 | C1 | 11/2001 |
| EP | 0256208 | A2 | 2/1988 |
| EP | 0322617 | A2 | 7/1989 |
| EP | 0894572 | A1 | 2/1999 |
| EP | 2177319 | A1 | 4/2010 |
| FR | 2755049 | A1 | 4/1998 |
| FR | 2837118 | A1 | 9/2003 |
| JP | 60123238 | A | 7/1985 |
| JP | 01193135 | A | 8/1989 |
| JP | 04143182 | A | 5/1992 |
| JP | 07328973 | A | 12/1995 |
| JP | 09192968 | A | 7/1997 |
| JP | 2000176874 | A | 6/2000 |
| JP | 2001105379 | A | 4/2001 |
| JP | 2003260626 | A | 9/2003 |
| SU | 1593956 | A1 | 9/1990 |
| WO | WO-9635547 | A1 | 11/1996 |
| WO | WO-03041913 | A1 | 5/2003 |
| WO | WO-2007/062279 | A2 | 5/2007 |

OTHER PUBLICATIONS

DE-STA-CO Modell 8005-7F brochure, 2 pages, published prior to May 5, 1998.

Tunkers GmbH PKS 50 U brochure, 1 page (believed to have been published Jul. 1995).

Written Opinion of the International Searching Authority dated Mar. 19, 2012; 10 pages.

BTM "1500 Series Rotary Clamp Drawings;" Drawing Sheets; offered for sale prior to Apr. 2009; 3 pages.

BTM "Grippers for High Speed Part Transfer in Press;" Brochure, published prior to May 5, 1998; 8 pages.

BTM "Locking Grippers;" Booklet, published prior to May 5, 1998; 27 pages.

BTM "Omni-Head Mini-Power Clamps;" Booklet, published prior to May 5, 1998; 4 pages.

BTM "Pin Locator Clamps for Locating and Clamping Through Holes in Sheet Metal;" Brochure, 732796C, published prior to Apr. 2010; 16 pages.

BTM "PLC Series Pin Locating Clamp for the Automotive Industry;" Brochure, published prior to Apr. 2010; 59 pages.

BTM "Precision Shot Pin Cylinders for Locating Production Material Through Precisely Pierced Holes;" Booklet, 732816, published prior to Apr. 2010; 12 pages.

BTM "1500 Series Retracting Power Clamp;" Booklet, published prior to May 5, 1998; 2 pages.

BTM "STC 50 Series Sealed Toggle Clamp-Blade Mount;" Booklet, published prior to May 5, 1998; 1 page.

BTM "Thin Power Clamps;" 2500-2000-390 Series, 1500-1000-140 Series, Booklet, published prior to May 5, 1998; 8 pages.

BTM "User Guide: Pin Locator Clamps;" Booklet, 732868A, published prior to Apr. 2010; 40 pages.

DE-STA-CO "Global DE-STA-CO Pin Clamps;" Booklet, published prior to Jan. 2010; 6 pages.

DE-STA-CO "Pneumatic Pin Clamps;" 82P Series, 52F Series and 52R Series, Brochure, published prior to Sep. 2007; 25 pages.

Tünkers GmbH "Operation Instructions Underbody Clamp;" K 60 U, published prior to Jan. 2001; 4 pages.

Tünkers GmbH "Operation Instructions Underbody Clamp;" K..Z, published prior to Jan. 2008; 1 page.

Tünkers GmbH "Underbody Clamp With Centering Pin, Manual Operated, Toggle Locked for Pin-Ø20-40mm With Pushing Device to Protect the Mechanism;" MK 60.1 UZ, excerpt from Brochure, published prior to Sep. 2006; 1 page.

Tünkers GmbH FK 50 UZ Underbody Clamp With Locating Pin and Swivel Hook for Locating Ø30-40, Specification, published prior to Dec. 2000; 1 page.

Tünkers Gmbh "Operating Instructions Pneumatic Clamps;" K 60 UZ, published prior to Jan. 2008; 3 pages.

Tünkers GmbH "Operating Manual Operating Clamp;" K/KD 40 UZ, published prior to Jun. 2009; 3 pages.

Vlier, Design Tips about Checknuts, about Detents and About the Nylon Locking Element, Vlier Selection Tips Standard Plungers and Stubby Plungers, Brochure, published prior to May 5, 1998; 3 pages.

* cited by examiner

PIN CLAMP

BACKGROUND

The disclosure pertains generally to powered clamps and more particularly to a powered clamp having a fail safe lock.

It is well known to employ powered clamps to retain sheet metal panels during welding or other assembly plant operations. Examples of such powered clamps include U.S. Pat. No. 5,165,670 entitled "Retracting Power Clamp" issued to Sawdon on Nov. 24, 1992, and U.S. Pat. No. 5,118,088 entitled "Power Clamp" which issued to Sawdon on Jun. 2, 1992; both of which are incorporated by reference herein. Traditional power clamps, however, are prone to unclamping the panel if the fluid pressure is lost. This can lead to damaged or misaligned parts.

More recently, detent and plunger arrangements, and offset piston mechanisms have been provided in an effort to overcome the traditional pressure lost concerns. For example, reference should be made to U.S. Pat. No. 6,378,855 entitled "Locking Pin Clamp" which issued to Sawdon et al. on Apr. 30, 2002, and U.S. Pat. No. 6,059,277 entitled "Retracting Power Clamp" which issued to Sawdon et al. on May 9, 2000; both of which are incorporated by reference herein. Notwithstanding, while the above-identified patents disclose significant inventions, there is still room for further improvement.

SUMMARY

In accordance with the present invention, a clamp having a lock is provided. In another aspect of the present invention, a fail safe lock maintains the position of a clamping member when fluid pressure or other actuating power is undesirably reduced. Another aspect of the present invention employs teeth on a locking structure which engage matching teeth on a rod or shaft where engagement of the teeth prevent unclamping of a workpiece. In still another aspect of the present invention, a manual override member disengages a lock in order to unclamp a workpiece. Yet another aspect of the present invention includes a cam and pin arrangement for a rotating pin clamp and a method of manufacturing same. A further aspect employs a clamp with longitudinal fluid flow paths through a housing with at least one of the paths extending internally through a piston. A method of using a locating pin clamp with a fail safe lock is also provided.

The present clamp is advantageous over conventional devices in that the present clamp achieves a more precise and secure locking function in order to maintain a clamping member in its workpiece-clamping position. Another advantageous aspect of the present clamp uses fluid pressure to disengage the lock from a movable member rather than prior camming or mechanical detent interfaces; in other words, the use of fluid pressure to retract the lock in the present clamp directly corresponds to clamping fluid pressure loss, rather than the mechanically indirect actions in some prior devices. The present clamp further employs a modularized body or housing, requires a minimal amount of parts, is easier and less costly to manufacture, and is easier to assemble as compared to certain conventional devices. Additional advantages and features of the present invention will become apparent from the following description and appended claims taken in conjunction with the accompanying drawings.

BRIEF DESCRIPTION OF THE DRAWINGS

The drawings described herein are for illustrative purposes only of selected embodiments and not all possible implementations, and are not intended to limit the scope of the present disclosure.

DETAILED DESCRIPTION

Figure 1:
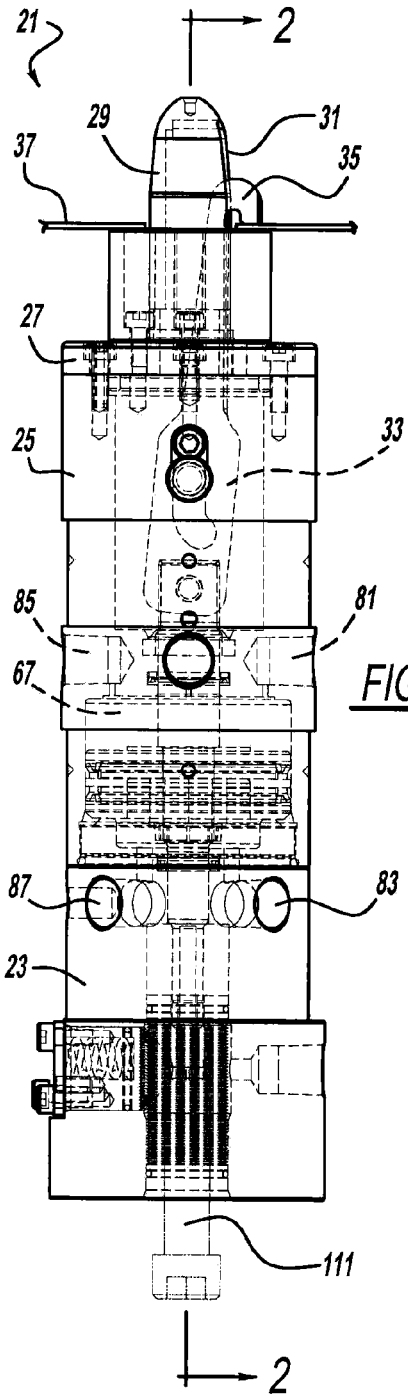
FIG. 1 is a side elevational view showing a first embodiment of a pin clamp shown in a workpiece-clamping position and with a lock in a retracted position.
Figure 2:
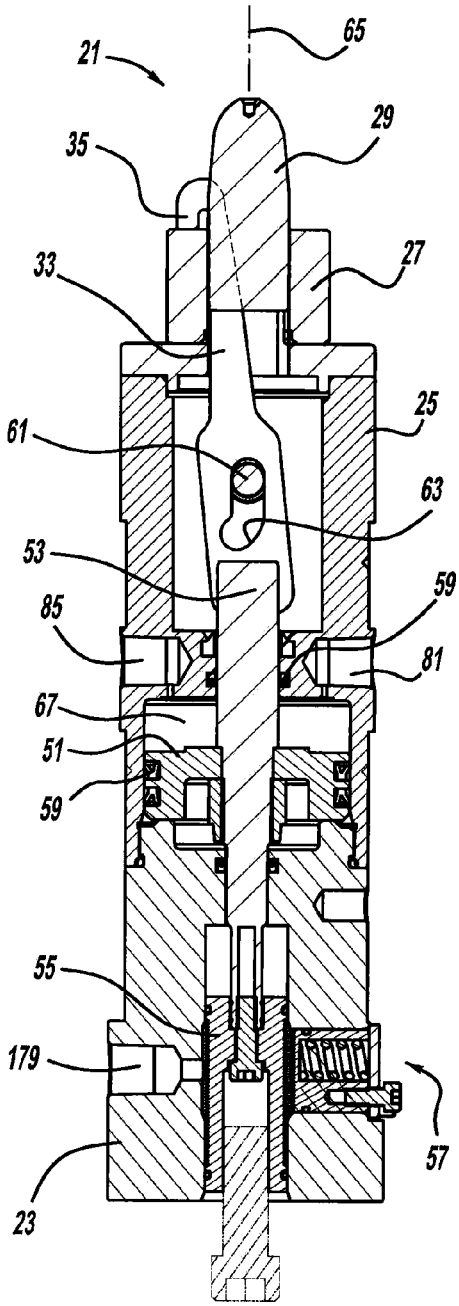
FIG. 2 is a longitudinal, cross-sectional view, taken along line 2-2 of FIG. 1, showing the first embodiment pin clamp in the workpiece-clamping position with the lock in the retracted position.
Figure 3:
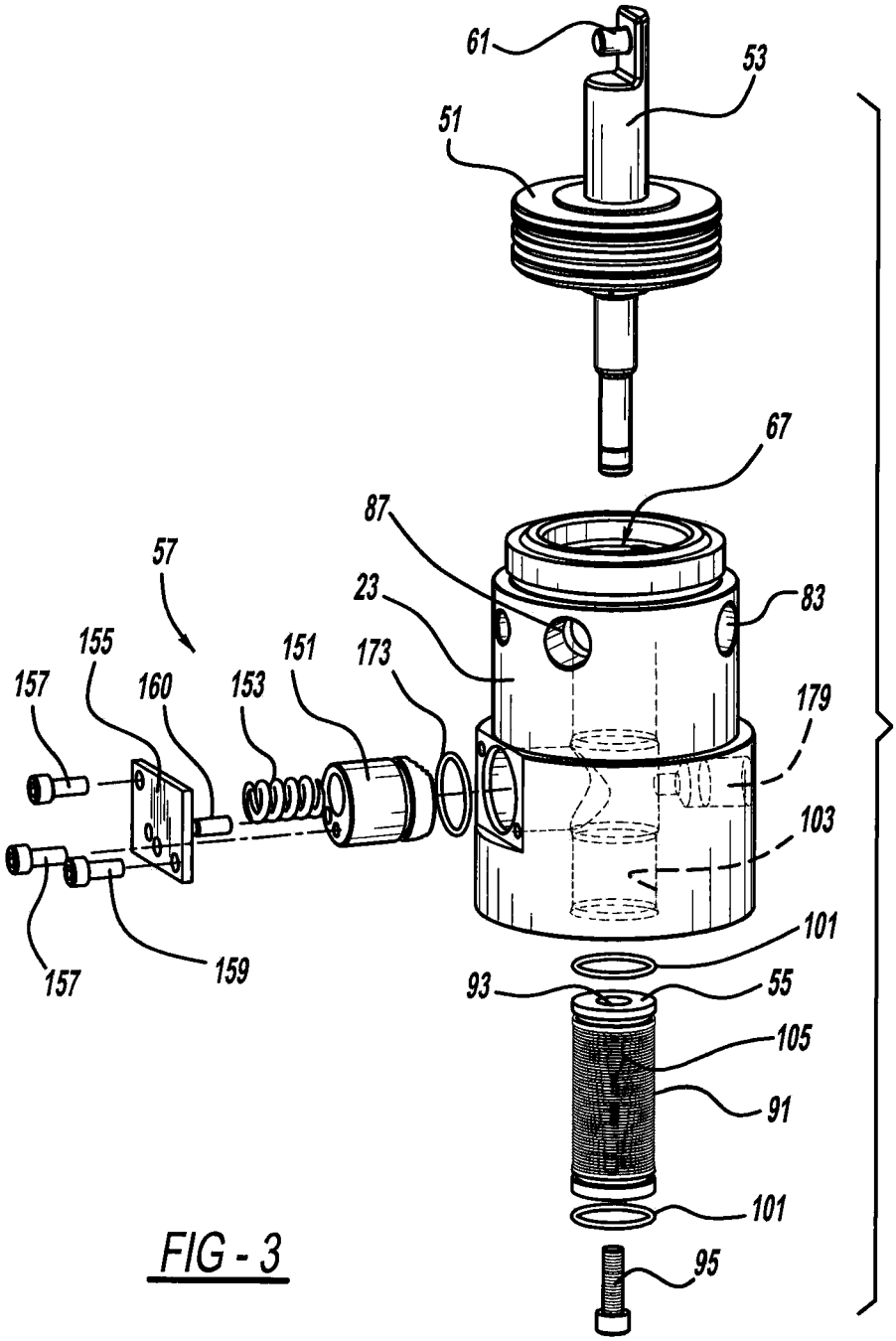
FIG. 3 is an exploded perspective view showing various components of the first embodiment pin clamp.

A locating pin clamp assembly 21 is shown in FIGS. 1-4. Clamp assembly 21 includes a pair of generally cylindrical housings or bodies 23 and 25 upon which is affixed a support cap 27. A tapered locating pin 29 is mounted to and projects from cap 27. A longitudinally elongated slot 31 is open along one lateral side of and through the center of locating pin 29. A clamping arm or member 33 is longitudinally and laterally movable within slot 31 of locating pin 29 such that a hook shaped distal end 35 of clamping arm 33 can be moved from a retracted and releasing position hidden within locating pin 29 to an advanced and clamping position (shown in FIG. 1) where the distal end contacts against and clamps a workpiece 37 against cap 27 after a hole within workpiece 37 has been aligned with and circumferentially surrounds locating pin 29. This is ideally suited for locating and holding the workpiece, which is preferably but not limited to a sheet metal, automotive vehicular body panel, during welding or other manufacturing plant operations.

Clamp assembly 21 further includes a piston 51, a piston rod or shaft 53, a locking rod or shaft 55, a locking mechanism 57, and multiple elastomeric O-rings or generally V-shaped seals 59. A pivot pin 61 located adjacent the first end of piston rod 53 is movable within a camming slot 63 of clamping arm 33. Furthermore, piston rod 53 is affixed within the center of piston 51. Thus, fluid, preferably pneumatic, pressure actuates piston 51 to advance and retract piston rod 53 and locking rod 55 in a longitudinal direction along a central axis 65 of clamp assembly 21. This piston and rod movement concurrently drive clamping arm 33 between its clamping and releasing positions which include longitudinally linear movement along axis 65 and rotational movement toward and away from axis 65. Piston 51 is movable within a piston chamber 67 which is in fluid communication with an inlet retraction port 81, an inlet advancing port 83, an outlet advancing port 85 and an outlet retracting port 87. The inlet ports are connected to an air compressor or other pressurized fluid source. Internal passageways connect the port to the piston chamber 67.

Locking rod 55 has a generally cylindrical exterior surface 91 and a generally hollow center 93. A threaded bolt 95 is located within hollow center 93 of the locking rod for fastening locking rod 55 to a proximal hollow end 97 of piston rod 53. Locking rod 55 and the adjacent end 97 of the piston rod are on an opposite side of piston 51 from clamping arm 33. Locking rod 55 is linearly and longitudinally movable in a bore 99 within a center of housing 23. A pair of O-rings 101 seal exterior surface 91 of locking rod 55 adjacent its end, to an internal surface 103 defining bore 99. At least twenty-five generally circumferentially arranged groove-like teeth 105 are machined into exterior surface 91 of locking rod 55 between O-rings 101. Teeth 105 are positioned to allow lock engagement anywhere during the entire stroke; small radii are present at the peaks of the one millimeter pitch and sixty degree angled teeth and a 10 micro finish is used. A threaded bolt 111 is optionally enmeshed with internal threads within hollow center 93 of locking rod 55. Optional bolt 111 provides a manual pulling projection to allow a maintenance technician to manually retract or advance piston 51 and clamping arm 33 when the pneumatic pressure is off, and when a manual override screw is actuated as will be discussed hereinafter.

As can best be observed in FIGS. 3-8, locking mechanism 57 includes a partially hollow lock structure 151, a compression spring 153, a plate 155 and an override screw 157. A set of fastening screws 159 attach plate 155 to an outside surface of housing 23 after lock 151 and spring 153 are assembled within a laterally oriented and cylindrically shaped passageway 171 extending from the outside surface of housing 23 to a laterally enlarged middle section of bore 99. An elastomeric O-ring 173 circumferentially seals an exterior of lock 151 to a wall defining passageway 171. One end of compression spring 153 abuts against an interior of plate 155 while an opposite end of spring 153 compresses and biases against a back side and internal face within the hollow of lock 151. Lock 151 has at least twenty teeth similar in construction to those on the locking rod, on a partially circular leading surface 175 of the lock. A dowl pin 160 is loosely inserted into a hole of lock 151, offset from both the hollow spring cavity and a threaded bore for override screw 157. An opposite end of dowl pin 160 is snuggly received within a tighter hole of end plate 155. Dowl pin 160 prevents rotation of lock 151 relative to its bore 171. There is a slight clearance between the dowl and its hole within lock 151 to allow for relative advancing and retracting movement therebetween.

Figure 5:
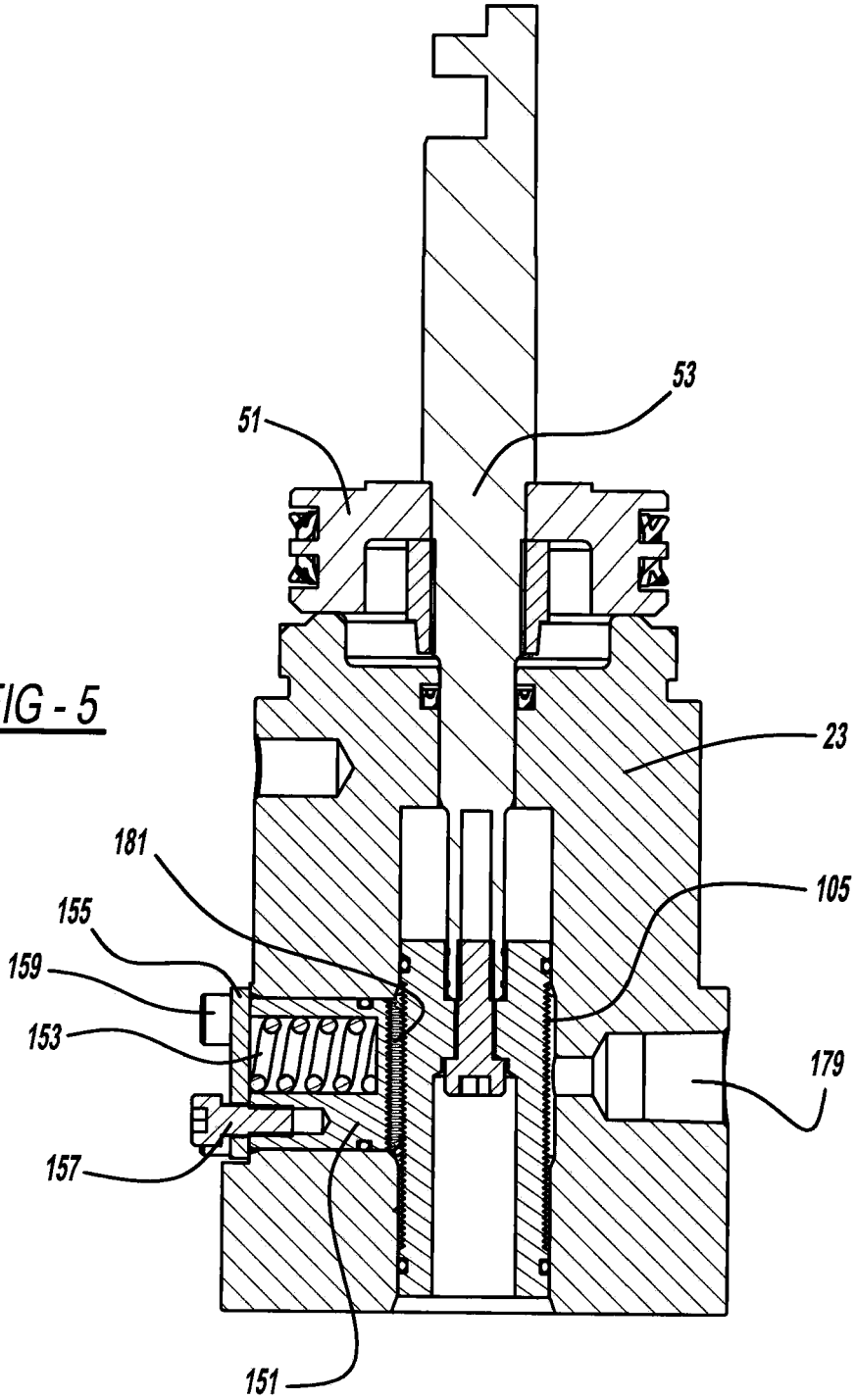
FIG. 5 is a longitudinal, cross-sectional view showing the components of the first embodiment pin clamp in the workpiece-clamping position and the lock in the retracted position.
Figure 6:
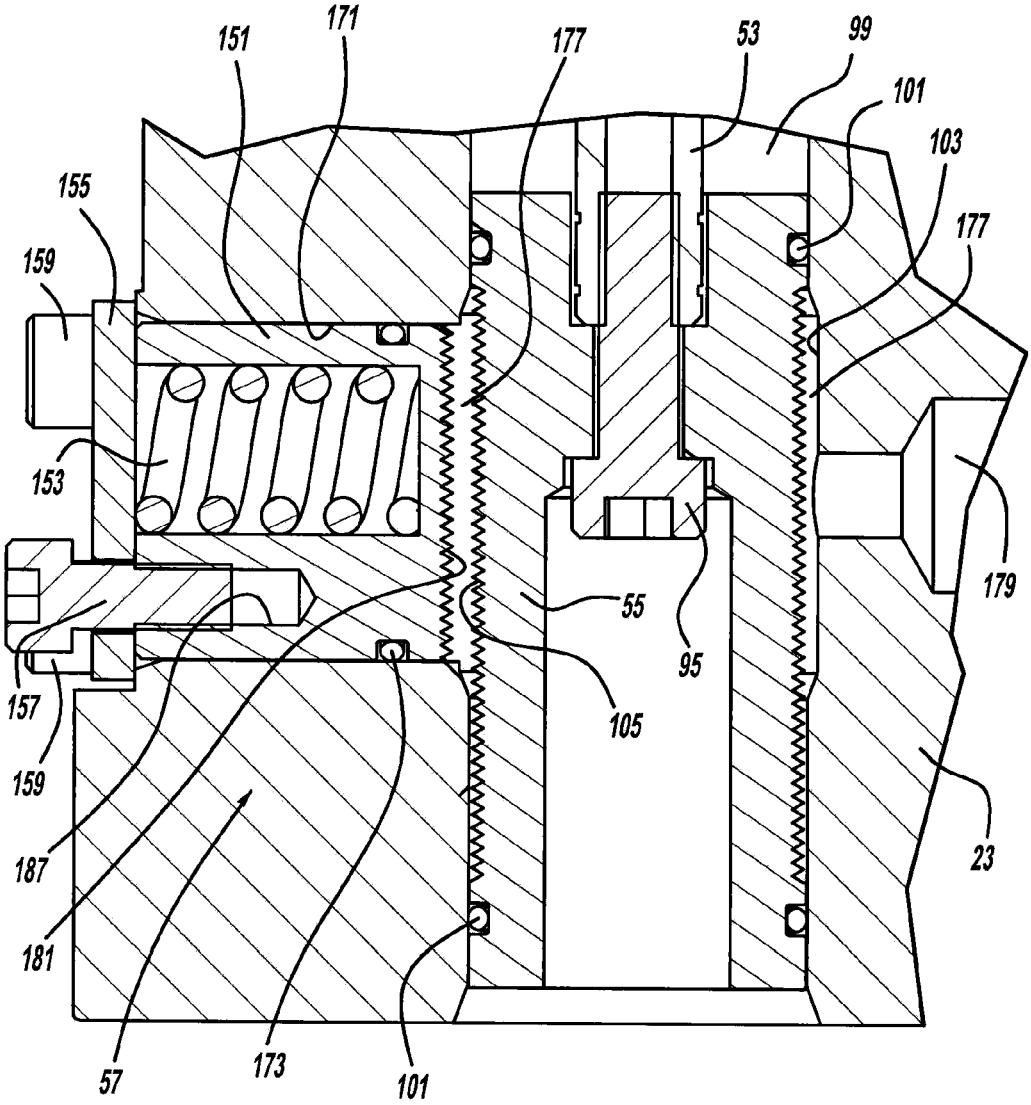
FIG. 6 is an enlarged longitudinal, sectional view, similar to that of FIG. 5, showing the first embodiment pin clamp with the lock in the retracted position.
Figure 8:
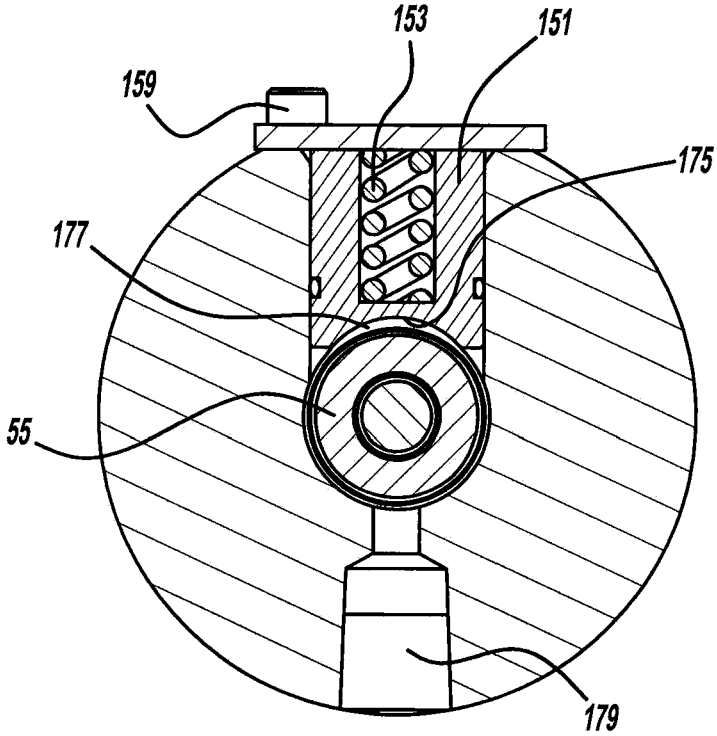
FIG. 8 is a cross-sectional view, like that of FIG. 7, showing the first embodiment pin clamp with the lock in the retracted position.
Figure 9:
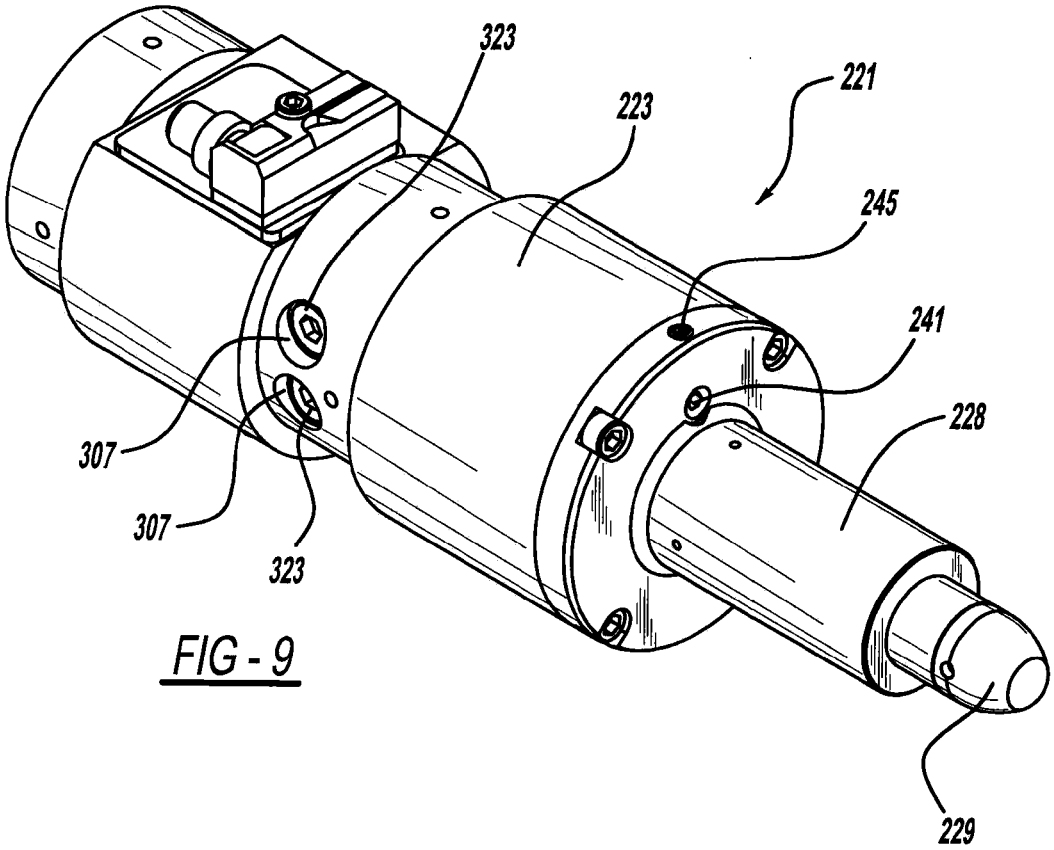
FIG. 9 is a perspective view showing a second embodiment of the pin clamp in a releasing and unclamping position.

When lock is retracted to the unlocking position shown in FIGS. 5, 6 and 8, a radial gap 177 is laterally created between the external surface of locking rod 55 and the internal surfaces 103 and 175 of housing 23 and lock 151, respectively, and longitudinally between O-rings 101. This gap provides a fluid passageway to allow air entering an inlet port 179 to flow around the middle of locking shaft 55 and outwardly push lock 151 into its retracted position. In the lock retracted position, teeth 181 are disengaged from teeth 105 of locking rod 55 such that locking rod 55 and the attached piston rod 53, piston 51 and clamping arm 33 (see FIG. 2) can freely advance and retract pursuant to the normal and desired pressurized actuation against the piston. However, if pneumatic pressure is undesirably lost or weakened from inlet ports 179 and 81 (see FIG. 2) then the air no longer causes lock 151 retraction and spring 153 therefore pushes lock away from plate 155 so that the teeth of lock 151 and locking rod 55 are engaged. This advantageously prevents unclamping of the clamping arm such that the workpiece is firmly held in position even during a power failure, pressure loss or other such undesirable manufacturing plant situation.

Figure 4:
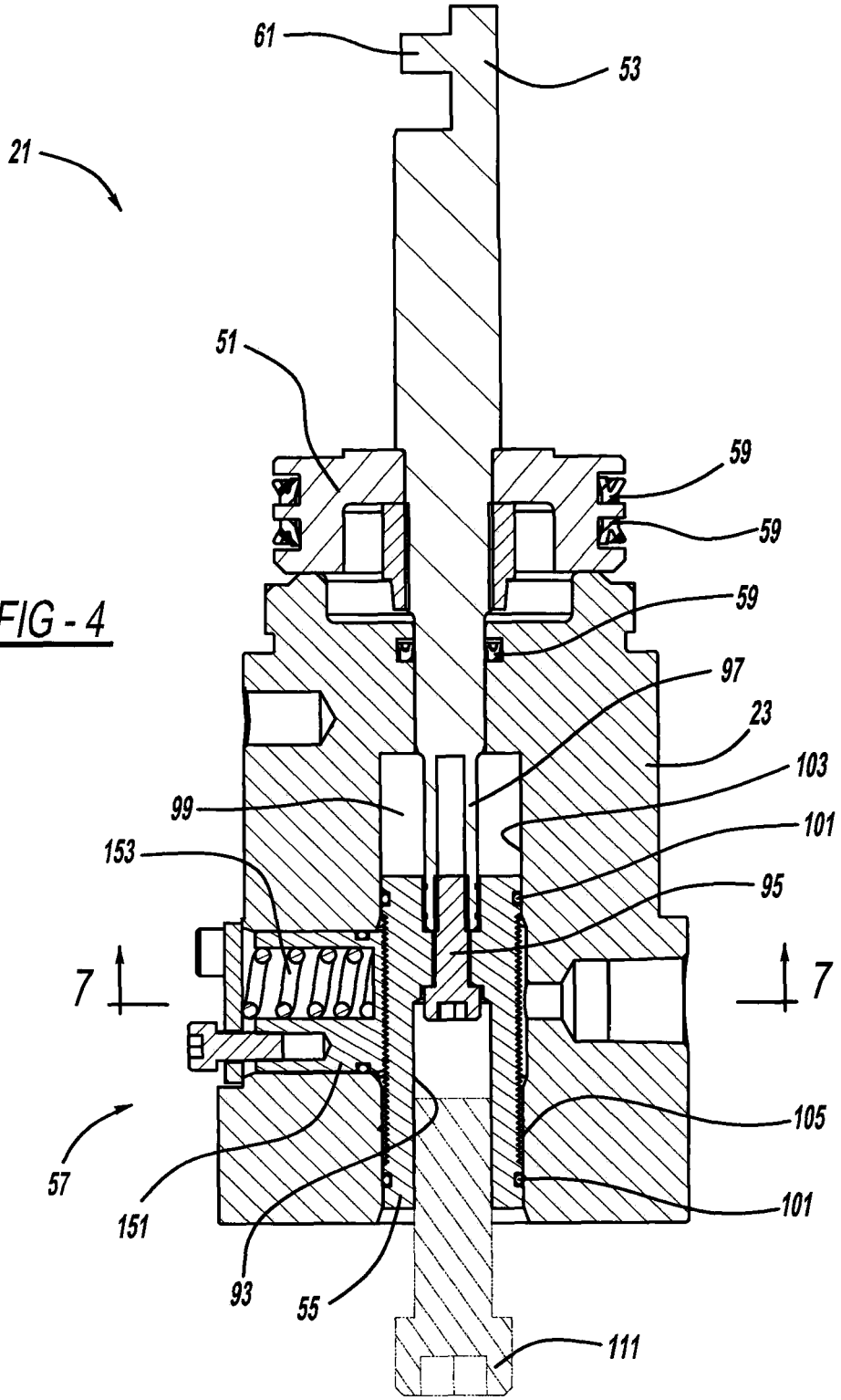
FIG. 4 is a longitudinal, cross-sectional view showing the components of the first embodiment pin clamp in the workpiece-clamping position and the lock in an advanced and locking position.
Figure 7:
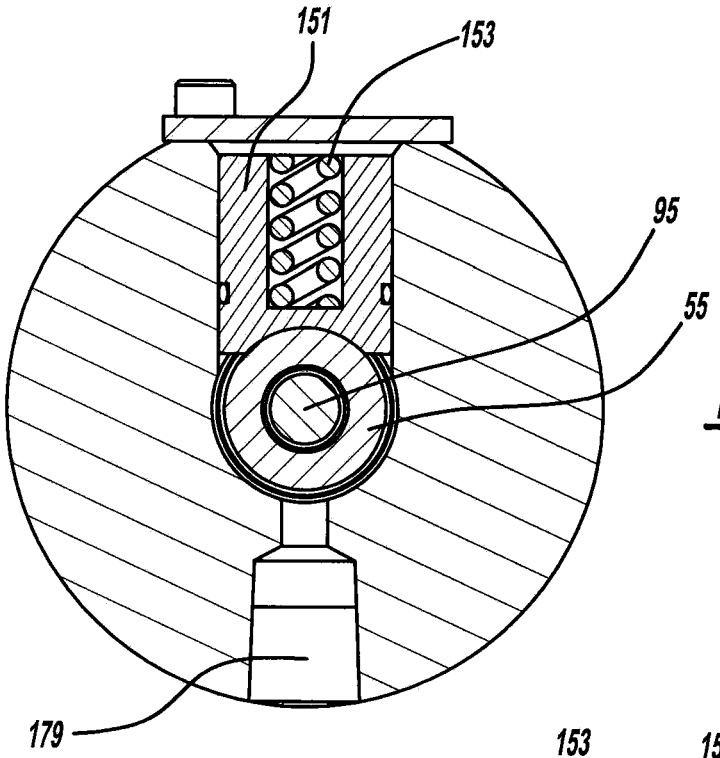
FIG. 7 is a cross-sectional view, taken along line 7-7 of FIG. 4, showing the first embodiment pin clamp with the lock in the advanced and locking position.

Override screw 157 provides a manual lock release function. Override screw 157 is essentially a shoulder screw having an enlarged head suitable for receiving an Allen head wrench or other screwdriver blade, an unthreaded shoulder which allows for movement relative to plate 155, and a threaded shank which engages an internal threaded hole 187 in lock 151. Override screw is offset from spring 153. If lock 151 is advanced to its locking shaft-engaging position, such as shown in FIGS. 4 and 7, but it is desired to advance the rods, piston and clamping arm to unclamp the workpiece, then the technician can manually tighten override screw 157 so that it withdraws lock 151 away from locking rod 55 to release their teeth.

Figure 15:
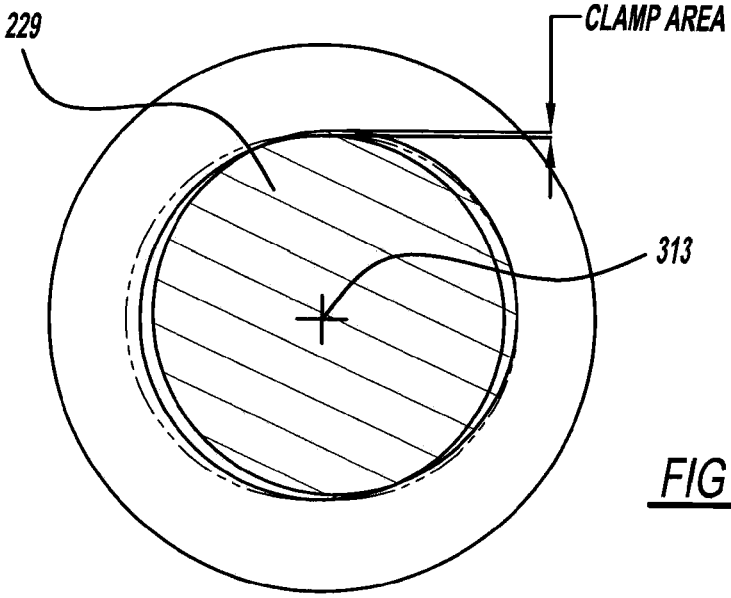
FIG. 15 is a top elevational view showing the second embodiment pin clamp in the clamping position.
Figure 10:
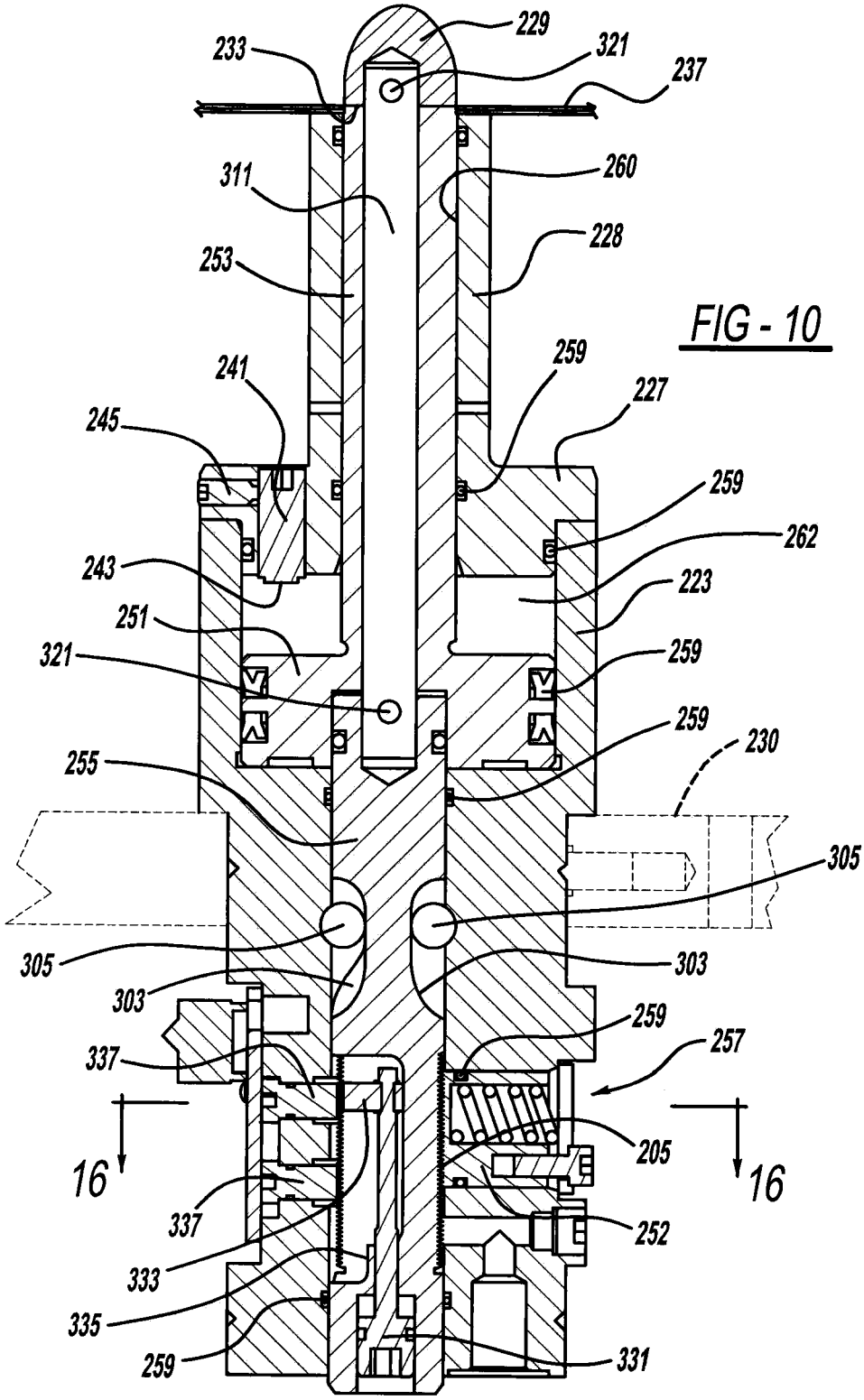
FIG. 10 is a longitudinal, sectional view showing the second embodiment of the pin clamp in a workpiece-clamping position and with a lock in an advanced and locking position.
Figure 11:
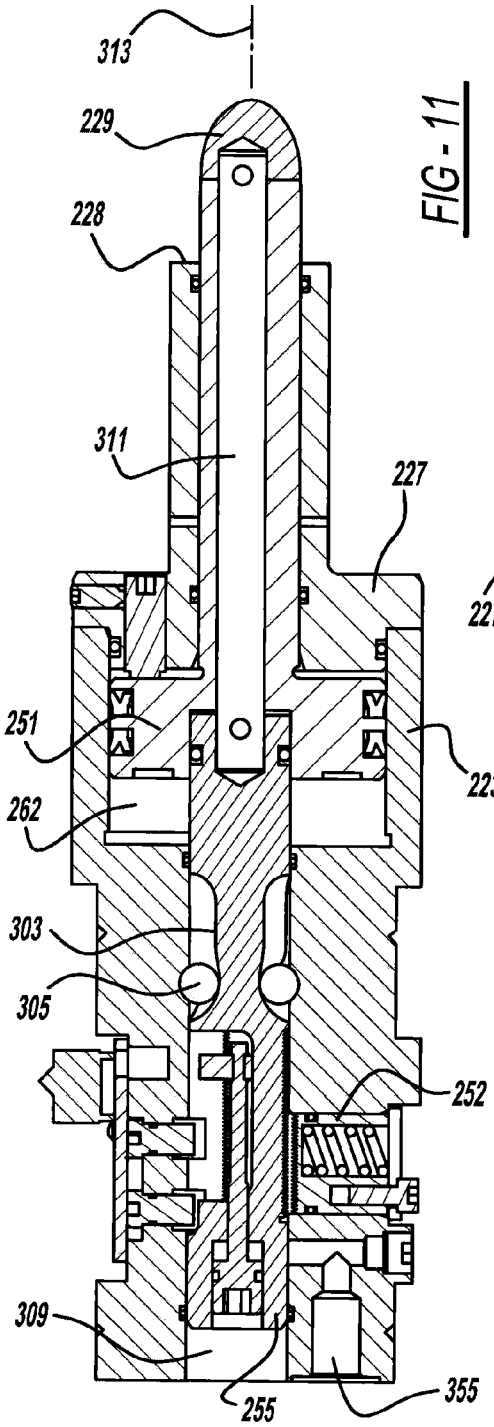
FIG. 11 is a longitudinal, sectional view, like that of FIG. 9, showing the second embodiment pin clamp in an unclamping position and with the lock in a retracted position.
Figure 12:
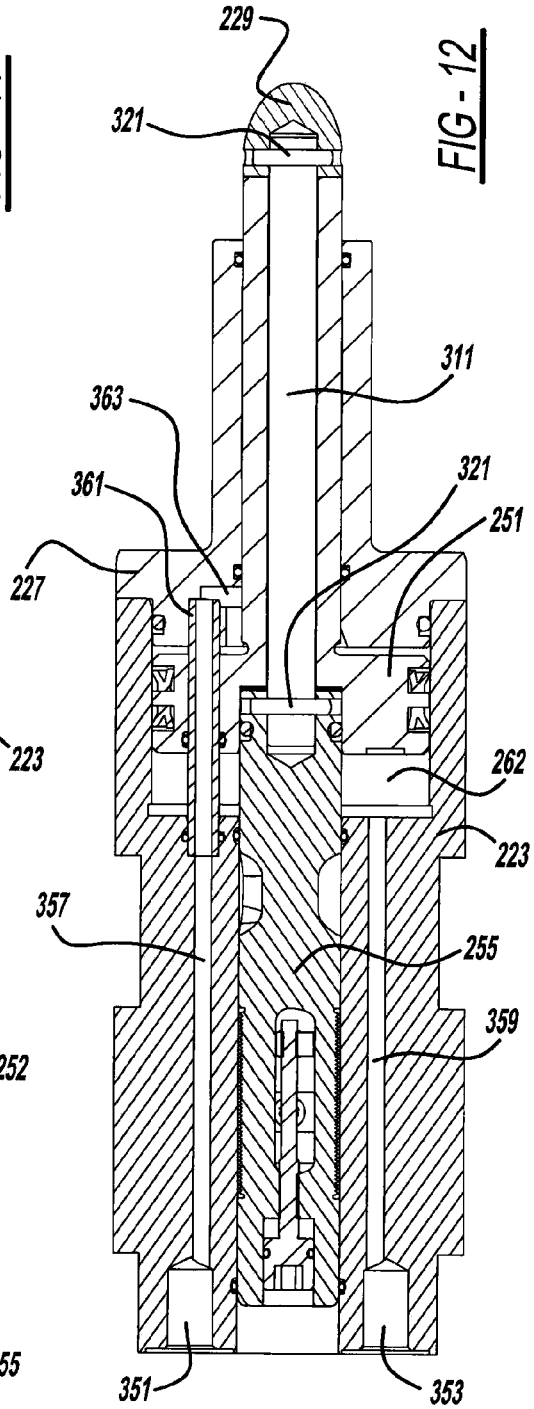
FIG. 12 is a longitudinal, sectional view taken 90° to that of FIG. 11, showing the second embodiment pin clamp in the releasing and unclamping position.
Figure 13:
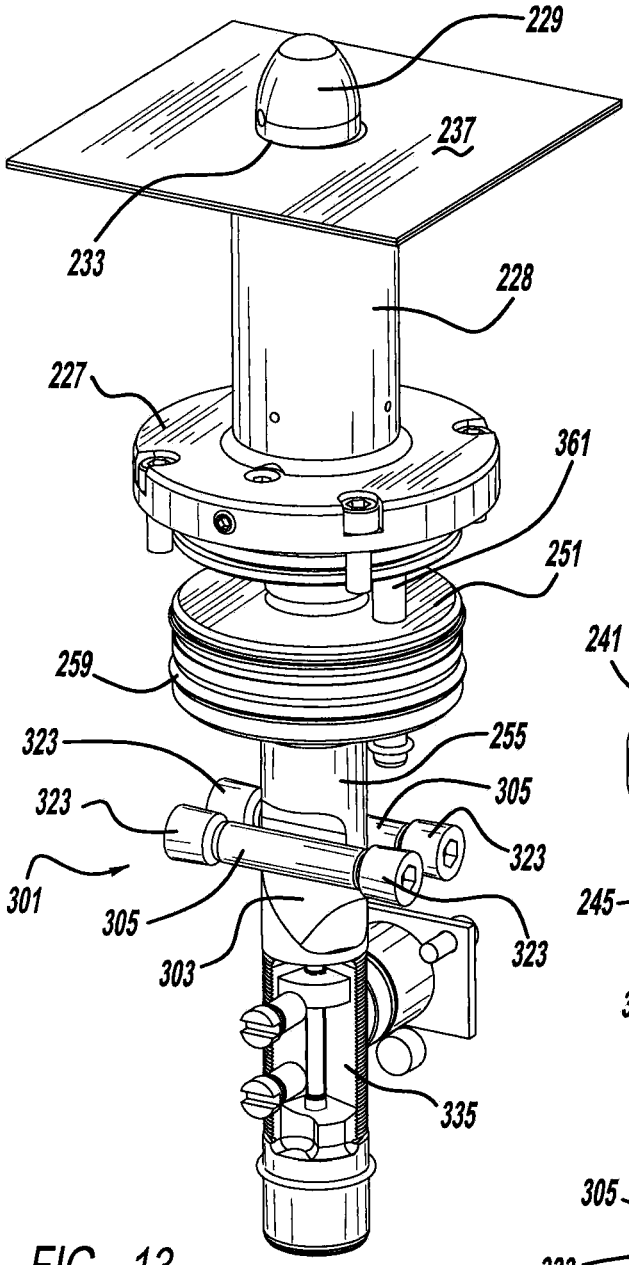
FIG. 13 is a perspective view, with the housing removed, showing the second embodiment pin clamp in the clamping position.
Figure 14:
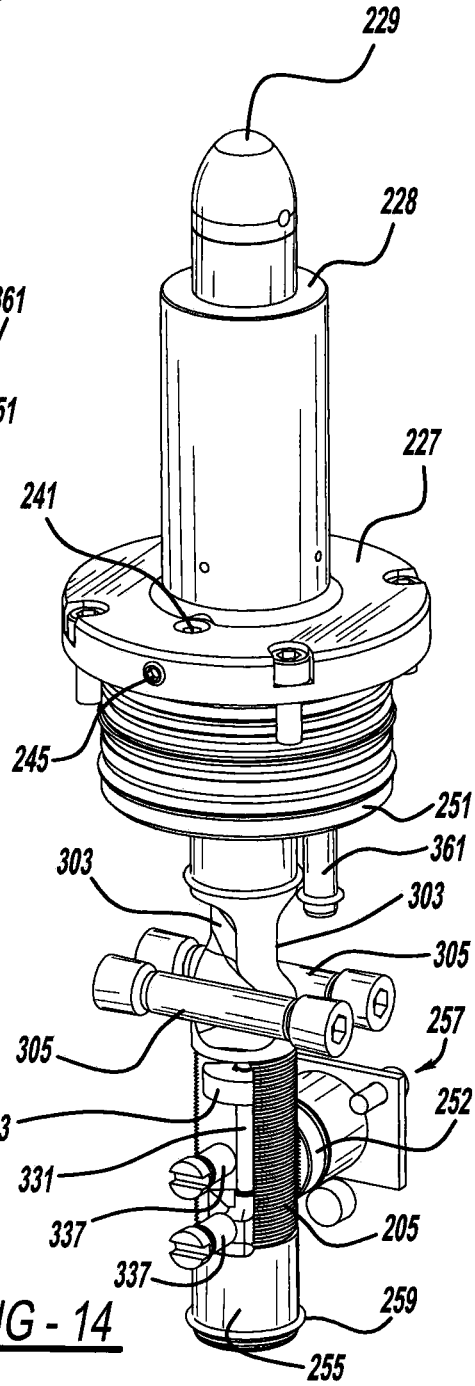
FIG. 14 is a perspective view, like that of FIG. 13, showing the second embodiment pin clamp in the released and unclamping position.
Figure 16:
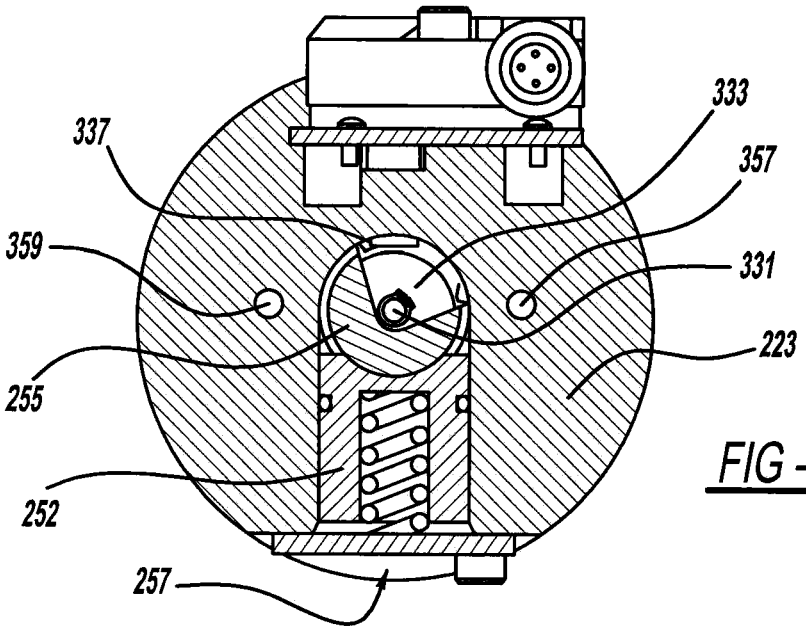
FIG. 16 is a cross-sectional view, taken along line 16-16 of FIG. 10, showing the second embodiment pin clamp with the lock in the advanced and locking position.
Figure 17:
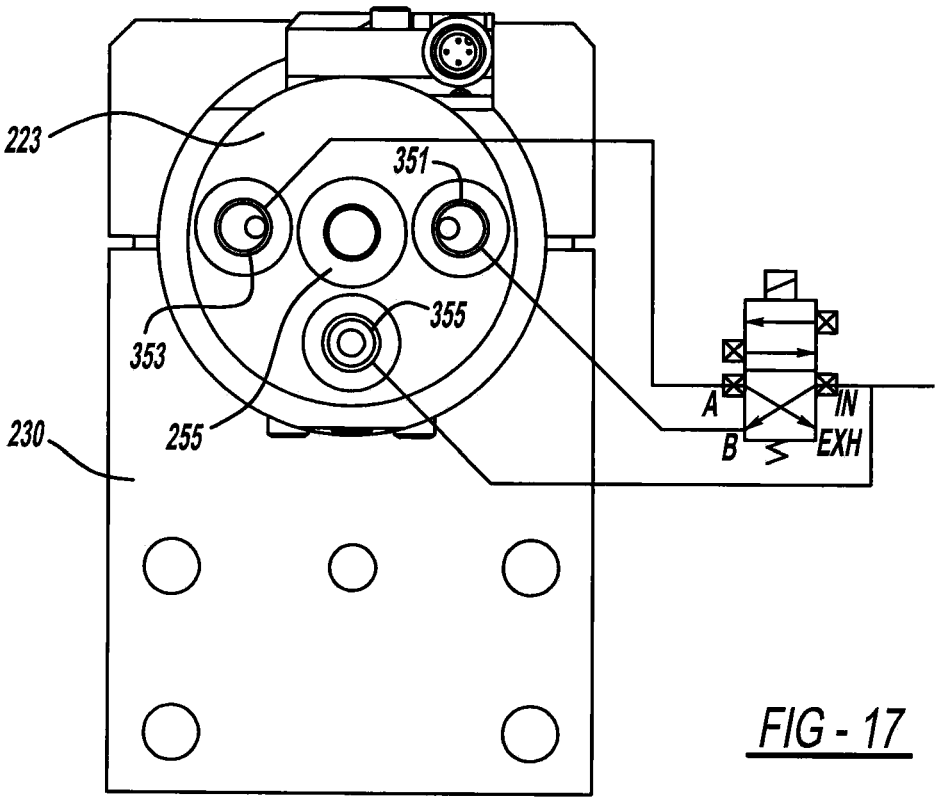
FIG. 17 is a partially schematic bottom elevational view showing the second embodiment pin clamp.

A second embodiment of a locating pin clamp 221 is shown in FIGS. 9-17. Clamp assembly 221 includes a generally cylindrical housing 223 upon which is affixed a support cap 227. A generally cylindrical extension 228 integrally extends as a single piece from the lateral portion of cap 227 and a top edge serves as an abutment platform against which sheet metal workpieces 237 are retained by a clamping finger or member ledge 233 of a tapered locating pin 229. Pin 229 is slightly eccentric relative to an axis 313 to provide the clamping area when rotated; this is shown in FIG. 15. A mounting bracket 230 is bolted to an outside of housing 223 for securing clamp assembly 221 to a factory floor-mounted fixture, machine or the like.

Clamp assembly 221 further includes a piston 251, a piston rod or shaft 253, a locking rod or shaft 255, a locking assembly 257, and multiple elastomeric O-rings or generally V-shaped seals 259. Piston rod 253 is integrally connected to piston 251 as a single piece and locking rod 255 is coaxially attached to piston 251. Piston 251 and rods 253 and 255 longitudinally advance and retract along axis 313 within a longitudinal bore 260 within cap 227 and a bore 309 in housing 223. Furthermore, piston 251 longitudinally advances and retracts within a piston chamber 262 defined by internal surfaces of housing 223 and cap 227. The spring and fluid actuated locking assembly 257 is generally the same as with the aforementioned first embodiment clamp assembly, such that teeth of a lock 252 operably engage matching teeth 205 of locking rod 255 when air pressure is undesirably reduced or lost to both lock 252 and piston 251.

A cam and cam follower mechanism 301 includes a pair of generally spirally-shaped cams 303 longitudinally elongated and oriented on opposite outside surfaces of locking rod 255. Mechanism 301 further includes a pair of cam followers, more specifically a generally cylindrical dowl pin 305 which interfaces with each cam 303. Each dowl pin is located within a laterally elongated hole 307 machined completely through opposite exterior surfaces of housing 223 for easy manufacture and assembly. Each hole 307 intersects outboard portions of longitudinally oriented bore 309 of housing 223 such that dowl pins 305 disposed therein ride along and serve to rotate locking rod 255; this serves to simultaneously rotate a drive pin 311 and the attached locating pin 229 and clamping finger 233 concurrently therewith about longitudinal advancing and retracting axis 313 from a released and unclamping position (see FIG. 11) to a retracted and clamping position (see FIGS. 10 and 15). Roll pins 321 or the like secure driving pin 311 to locating pin 229 and locking rod 255. Externally threaded plugs 323 inserted into each end of lateral holes 307 of housing 223 to loosely retain dowl pins 305 therebetween. It may be desirable to apply grease to dowl pins 305 and/or cam surfaces 303.

The camming mechanism provides approximately 45° of rotation to clamping finger 233 between its released and clamping positions. An adjustment screw 241, however, is provided to add further precision to the exact clamping position and to allow for adjustment of same after the clamp is assembled and used in a manufacturing plant environment. Adjustment screw 241 is threadably enmeshed within an aperture of cap 227 and is rotatable by an Allen head wrench, or alternately a screwdriver. A leading end 243 of adjustment screw 241 protrudes into piston chamber 262, and operably abuts against an opposing face of piston 251 in order to set and limit the advancing stroke travel of the piston. A supplemental set screw 245 is laterally enmeshed in an associated hole in cap 227. Set screw 245 is made of a softer brass material such that a leading end thereof is pushed into external threads of adjusting screw 241 to hold it in its desired adjustment position and to prevent loosening or backing out of adjustment screw 241 during normal repeated usage of clamp assembly 221. Adjustment screw 241 advantageously changes the total stroke distance to allow clamping of different workpiece thicknesses or quantities but in an externally accessible and quick manner.

An externally threaded and longitudinally elongated bolt 331 is attached adjacent an end of locking rod 255 on an opposite side of piston 251 from clamping finger 233. Bolt 331 has a metallic sensor flag 333 attached to a leading end thereof by a circlip or the like. Bolt 331 and the attached flag 333 can be longitudinally positioned at various locations within a cavity 335 inside locking rod 255. The location of flag 333 is sensed by sensors 337 of a proximity switch in order for the proximity switch to determine the stroke position of locking rod 255 and the associated piston and clamping finger which longitudinally advance and retract therewith. Accordingly, bolt 331 and the internal cavity location of flag 333 serve to provide a compactly packaged and protected location while providing essentially infinite adjustment of the sensing flag, with the adjustment being accessible from outside of the clamp after the clamp has been assembled and installed in the manufacturing plant.

An air pressure port or inlet 351 for clamping/piston retraction, a port or inlet 353 for loading/unloading and piston advancement, and a constant air port or inlet 355 for retracting lock 252, are all present on the bottom end of housing 223. A single pneumatic supply line is connected to a Tee supply from which the constant air has an air dump valve located in a safe area outside of the manufacturing plant working cell. Air conduits 357 and 359 are in communication with inlets 351 and 353, respectively, and are longitudinally drilled from the bottom of housing 223. Conduit 359 is directly accessible to the bottom portion of piston chamber 262 between piston 251 and the opposing face of housing 223. A hollow tube 361 provides a pneumatic flow path between an upper end of conduit 357 and a passageway 363 in cap 227, which is then accessible to an upper portion of piston chamber 262 between piston 251 and the opposing surface of cap 227. Tube 361 is firmly and stationarily trapped between housing 223 and cap 227, and there is a slight lateral clearance between the middle of tube 361 and an adjacent aperture in piston 251 to allow the piston to move relative to the tube. O-rings are provided to seal the exterior of tube 361 to the adjacent portions of the housing and piston. This tube advantageously provides a multi-functional benefit of substantially preventing rotation of piston 251 while also providing a very direct fluid flow path from the bottom end of housing 223 to the opposite and upper end of the piston without requiring the traditional lateral machined apertures and the many expensive to make right angles of conventional clamp flow paths. This direct and longitudinal flow path arrangement internal with the piston advantageously allows lower cost and easier flow path manufacturing while also allowing for thinner housing walls and the associated reduction in material weight.

While various features of the present invention have been disclosed, it should be appreciated that modifications can be made. For example, the locking mechanism may engage a piston rod between a piston and clamping arm although certain advantages of the present clamps may not be realized. Furthermore, the locking mechanism disclosed herein may engage shafts or other moveable components used in other types of powered clamps and grippers such as those disclosed in the following U.S. Pat. No. 7,370,856 entitled "Rotating Head Pin Clamp" which issued to Sawdon et al. on May 13, 2008; U.S. Pat. No. 5,884,903 entitled "Powered Clamp and Gauging Apparatus" which issued to Sawdon on Mar. 23, 1999; and U.S. Pat. No. 5,853,211 entitled "Universal Gripper" which issued to Sawdon et al. on Dec. 29, 1998; all of which are incorporated by reference herein, however, all of the advantages of the present clamps may not be obtained. Moreover, different mechanical locking patterns may be utilized between the lock and locking shaft instead of the disclosed teeth to create a firm locking engagement; for example, a knurl pattern, a large array of facing pyramidal projections, multiple tapered pin and hole features, and the like may be used, although such may forego the benefits realized with the present clamps. It is alternately envisioned that differently shaped clamping arms, bodies, rods and locks may be employed, although certain advantages of the present clamps may not be achieved. Alternate acuators, such as hydraulically-powered pistons or electromagnetic drivers, can be used, however, various advantages of the preferred clamps may be forfeited. It is intended by the following claims to cover these and any other departures from the disclosed embodiment which follow in the true spirit of this invention.

The invention claimed is:

1. A clamp comprising:

a piston moveable between an advanced position and a retracted position;

at least one rod moving with the piston, the rod further comprising a first set of locking teeth;

a workpiece-clamping member coupled to and being driven by the piston between a clamping position and a releasing position; and a fail safe lock comprising a second set of locking teeth, the lock maintaining a position of the clamping member by engaging the first and second sets of locking teeth if an undesirable operating condition exists, and fluid pressure operably pushing the lock to an unlocking location and disengaging the first and second sets of locking teeth if a desirable operating condition exists.

2. The clamp of claim 1, further comprising:

the at least one rod connected to the piston; and a tapered workpiece-locating pin substantially coaxially aligned with the at least one rod, the pin having an opening in a side thereof;

the clamping member including a workpiece-contacting end operably advancing and retracting through the opening in the pin in response to movement of the piston, and an opposite end of the clamping member being pivotally coupled to the at least one rod; and the lock engaging the at least one rod to deter workpiece-unclamping by the clamping member if the undesirable operating condition exists.

3. The clamp of claim 2, wherein the at least one rod includes two rods with the clamping member and piston being attached to one of the rods and the lock operably engaging the second of the rods.

4. The clamp of claim 1, wherein at least one of the first and second sets of locking teeth comprise at least twenty-five substantially circumferentially arranged groove teeth.

5. The clamp of claim 1, further comprising a clamp housing, wherein a fluid chamber is located adjacent and accessible to a section of the rod within the housing, a rod-contacting surface of the lock being accessible to the fluid chamber, and when fluid pressure is applied within the chamber the fluid pressure pushes the lock away from the rod.

6. The clamp of claim 1, further comprising a spring, and a rotatable override screw attached to the lock, the screw being offset from the spring, rotation of the screw causing the lock to retract away from a longitudinal centerline of the piston in order to allow the clamping member to move from its clamping position to its releasing position.

7. The clamp of claim 1, wherein the undesirable condition exists if fluid pressure is undesirably reduced against the piston when the clamping member is in its clamping position, and the clamp is a locating pin clamp.

8. The clamp of claim 1, further comprising movement of cams relative to cam followers operably rotating the clamping member about a piston advancing and retracting axis, the cams being on a rod coaxially coupled to the piston, the cam followers being journalled to a clamp housing.

9. The clamp of claim 1, wherein the clamping member includes a hook-like shape and a camming slot, the clamping member being elongated substantially parallel to an advancing axis of the piston.

10. A clamp comprising:

a workpiece-clamping member moveable from a clamping position to a releasing position;

a piston moveable within a piston chamber between an advanced position and a retracted position, the piston driving the clamping member between the clamping and releasing positions;

at least one rod connected to and moveable with the piston, the rod comprising a plurality of grooves;

a structure moveable in a substantially lateral direction toward and away from the at least one rod, the structure comprising a leading surface matingly engageable with the grooves of the rod; and a housing having at least one bore within which the at least one rod moves, a gap between an exterior surface of the at least one rod and interior surfaces of the housing and structure defining an internal fluid cavity operably receiving a pressurized fluid therein for disengaging the leading surface of the structure from the grooves of the rod.

11. The clamp of claim 10, further comprising a spring moving the structure toward the at least one rod when fluid pressure is reduced in the fluid cavity and the piston chamber.

12. The clamp of claim 10, wherein the structure is a fail safe lock which engages and holds a position of the at least one rod to prevent undesired movement of the clamping member.

13. The clamp of claim 10, further comprising:

a tapered workpiece-locating pin substantially coaxially aligned with the at least one rod, the pin having an opening in a side thereof;

the clamping member including a laterally extending workpiece-contacting finger at a distal end thereof, a proximal end of the clamping member being pivotally coupled to the at least one rod, the finger operably advancing and retracting through the opening in the pin in response to movement of the piston; and the structure engaging the at least one rod to deter workpiece-unclamping by the clamping member if fluid pressure is reduced in the fluid cavity and the piston chamber.

14. The clamp of claim 10, wherein the at least one rod includes two rods with the clamping member and piston being attached to one of the rods and the structure operably engaging the second of the rods if the fluid pressure is reduced.

15. The clamp of claim 10, wherein the leading surface of the structure comprises teeth and the grooves of the rod comprise at least twenty-five groove-like teeth projecting from the exterior surface of the at least one rod, the structure teeth engaging the rod teeth if fluid pressure is reduced.

16. The clamp of claim 10, further comprising a cam and cam-follower causing the clamping member to rotate about a piston advancing and retracting axis, the cam being on a rod coaxially coupled to the piston and the cam-follower having ends located in a hole extending entirely through the housing and being plugged at both ends of the hole.

17. A clamp comprising:

a housing;

an actuator moveable within the housing;

an elongated shaft coaxially coupled to and moveable with the actuator, the shaft including teeth;

a workpiece-clamping surface coupled to and being driven by the actuator between a clamping position and a releasing position; and a structure including teeth;

engagement of the teeth of the structure and shaft holding a position of the shaft, when the structure is moved to an inward position in the housing; and disengagement of the teeth of the structure and shaft allowing the shaft to move relative to the structure, when the structure is moved to an outward position in the housing independently of the shaft.

18. The clamp of claim 17, further comprising pressurized fluid moving the structure to its outward position.

19. The clamp of claim 17, further comprising a spring moving the structure to its inward position, at least part of the spring fitting within a hollow of the structure, the teeth engagement creating a locking condition for the shaft if actuation power ceases.

20. The clamp of claim 17, further comprising a tapered workpiece-locating pin mounted to the housing.

21. The clamp of claim 17, further comprising at least two seals sealing the shaft to a bore within the housing, the teeth of the shaft being located between the seals, and the structure being moveable substantially perpendicular to the movement direction of the shaft.

22. The clamp of claim 17, wherein:

the clamp is a locating pin clamp.

23. A clamp comprising:

a housing;

an actuator moveable within the housing;

an elongated shaft coaxially coupled to and moveable with the actuator, the shaft including teeth;

a workpiece-clamping surface coupled to and being driven by the actuator between a clamping position and a releasing position; and a structure including teeth;

engagement of the teeth of the structure and shaft holding a position of the shaft, when the structure is moved to an inward position in the housing;

disengagement of the teeth of the structure and shaft allowing the shaft to move, when the structure is moved to an outward position in the housing; and an adjustment screw abutting against the actuator adjustably setting an end of movement position thereof, the screw being adjustable from outside the housing.

24. A clamp comprising:

a moveable workpiece-clamping member for clamping multiple workpiece thicknesses;

an actuator operably moving the clamping member;

at least one longitudinally elongated rod connected to the actuator; and a fail safe lock located on an opposite side of the actuator from the clamping member, the lock having a plurality of teeth operably maintaining a position of the clamping member when the lock is engaged regardless of the workpiece thickness, and the lock being laterally moveable relative to the actuator.

25. The clamp of claim 24, further comprising:

a tapered workpiece-locating pin substantially coaxially aligned with the at least one rod, the pin having an opening in a side thereof;

the clamping member including a laterally extending workpiece-contacting finger at a distal end thereof, a proximal end of the clamping member being pivotally coupled to the at least one rod, the finger operably advancing and retracting through the opening in the pin in response to energization of the actuator; and the lock engaging the at least one rod to deter undesired workpiece-unclamping by the clamping member.

26. The clamp of claim 24, wherein the rod moves with the clamping member, the rod includes a set of teeth, and the plurality of teeth of the lock operably engage the teeth of the rod when actuation force is lost.

27. The clamp of claim 24, further comprising the rod moving with the actuator which is a piston, a clamp housing, and a fluid cavity circumferentially surrounding a section of the rod within the housing, a rod-contacting portion of the lock being accessible to the fluid cavity, and fluid pressure applied within the cavity pushing the lock away from the rod.

28. The clamp of claim 24, further comprising a manually rotatable override screw attached to the lock, rotation of the screw causing the lock to retract away from a longitudinal centerline of the actuator in order to allow the clamping member to move from a clamping position to a releasing position, the screw being enmeshed with a section of the lock.

29. The clamp of claim 28, wherein the lock engages if fluid pressure is undesirably reduced against the actuator when the clamping member is in its clamping position, and the clamp is a locating pin clamp.

30. The clamp of claim 24, further comprising a cam rotating the clamping member about an advancing and retracting axis, the cam being on the at least one rod coaxially moveable along the axis, and the lock and cam being located on an opposite side of the actuator from the clamping member.

31. A clamp comprising:

a moveable workpiece-clamping member;

a piston actuator moving the clamping member;

a lock maintaining the position of the clamping member in a power failure condition;

an override member directly connected to the lock, manual rotation of the override member causing the lock to retract and allow movement of the clamping member; and a rod including a set of teeth, the lock further comprising a set of teeth which engage the teeth of the rod during the power failure condition.

32. The clamp of claim 31, wherein the override member is a threaded screw having a thread enmeshed with the lock, the screw having an enlarged head, and the lock including a hollow core.

33. The clamp of claim 31, further comprising:

at least one rod connected to the actuator; and a tapered workpiece-locating pin substantially coaxially aligned with the at least one rod;

the lock engaging the at least one rod to deter workpiece-unclamping by the clamping member in the power failure condition.

34. The clamp of claim 31, further comprising:

a housing within which the lock laterally moves;

a removeable plate coupling the override member to the housing; and a spring biasing the lock relative to the plate with the spring contacting both;

the override member being offset from the spring.

35. A clamp comprising:

a housing including a bore elongated in a longitudinal direction and a hole elongated in a lateral direction, the hole and bore intersecting each other, the hole extending completely through opposite lateral sides of the housing;

a piston moveable within the housing;

at least one rod connected to the piston and operably advancing and retracting coaxially within the bore;

a camming surface located on the at least one rod;

a cam-follower elongated in the lateral direction and having ends thereof located in the hole of the housing on either lateral side of the bore; and a first plug closing a first end of the hole;

a second plug closing a second and opposite end of the hole, the cam-follower being located in the hole between the plugs; and a workpiece-clamping member coupled to the at least one rod and being rotated in response to movement of the cam interacting with the cam-follower during movement of the piston.

36. The clamp of claim 35, further comprising:

a second laterally elongated hole in the housing intersecting the bore, the second hole being substantially parallel to the first hole and extending completely through opposite lateral sides of the housing;

a second camming surface located on the rod; and a second cam-follower located in the second hole.

37. The clamp of claim 35, wherein the camming surface is on an opposite side of the piston from the clamping member.

38. The clamp of claim 35, further comprising:

a tapered workpiece-locating pin extending from an end of the housing; and a cap including a laterally enlarged section attached to the end of the housing, the laterally enlarged section defining a surface of a piston chamber within which the piston moves, a longitudinally elongated section of the cap acting as a workpiece support against which the clamping member secures a workpiece;

the longitudinally elongated section of the cap closest to the clamping member having an outside lateral dimension less than half of the laterally enlarged section of the cap.

39. A clamp comprising:

a housing including a piston chamber;

a cap attached to the housing and defining at least one surface of the piston chamber;

a piston operably advancing and retracting in a longitudinal direction within the piston chamber;

a workpiece-clamping member moveable in response to movement of the piston;

an adjustment member being attached to one of the cap and the housing, a trailing end of the adjustment member being accessible to and manually moveable from outside the clamp, a leading end of the adjustment member extending inside the piston chamber and operably abutting against the piston to limit piston travel in a manually adjustable manner; and a screw engaging and maintaining the position of the adjustment member, the adjustment member being externally threaded.

40. A clamp comprising:

a housing including a piston chamber;

a cap attached to the housing and defining at least one surface of the piston chamber;

a piston operably advancing and retracting in a longitudinal direction within the piston chamber;

a workpiece-clamping member moveable in response to movement of the piston;

an adjustment member being attached to one of the cap and the housing, a trailing end of the adjustment member being accessible to and manually moveable from outside the clamp, a leading end of the adjustment member extending inside the piston chamber and operably abutting against the piston to limit piston travel in a manually adjustable manner;

the clamp being a locating pin clamp;

the adjustment member being operably adjusted toward and away from the piston substantially parallel to the longitudinal direction, and the adjustment member being externally threaded; and a sensor attached to the housing and a sensed flag adjustably attached inside a rod moveable with the piston.

41. The clamp of claim 40, further comprising a screw engaging and maintaining the position of the adjustment member, the adjustment member being externally threaded.

* * * * *